US005934358A

United States Patent [19]

Ellis et al.

[11] Patent Number: 5,934,358

[45] Date of Patent: Aug. 10, 1999

[54] MAGNETIC BRAKING

[75] Inventors: Peter James Ellis, Ferntree Gully; Mary Mei Lei Ng, Mulgrave; Leslie George Gore, Balgownie, all of Australia

[73] Assignees: Ishikawajima-Harima Heavy Industries Company Limited, Tokyo, Japan; BHP Steel (JLA) Pty Ltd, Melbourne, Australia

[21] Appl. No.: 08/840,071

[22] Filed: Apr. 24, 1997

[30] Foreign Application Priority Data

Apr. 29, 1996 [AU] Australia ..... PN9539
Sep. 23, 1996 [AU] Australia ..... P02507

[51] Int. Cl.[6] ..... B22D 11/00; B22D 27/02

[52] U.S. Cl. ..... 164/466; 164/502; 164/488; 164/480; 222/606

[58] Field of Search ..... 164/500, 466, 164/146, 147.1, 502, 437, 488, 480, 428; 222/594, 606, 607

[56] References Cited

U.S. PATENT DOCUMENTS 5,238,050 8/1993 Folder et al. ..... 164/437

FOREIGN PATENT DOCUMENTS 61-154739 6/1986 Japan ..... 164/502
728145 4/1955 United Kingdom ..... 164/502

*Primary Examiner*—Kuang Y. Lin
*Attorney, Agent, or Firm*—Nikaido, Marmelstein, Murray & Oram LLP

[57] ABSTRACT

Method and apparatus for retarding a flow of molten metal to a metal caster. The flow of molten metal is confined within a duct 11 having an elongate cross-section transverse to the flow directions to shape the flow in a sheet formation. The sheet formation flow is subjected to a magnetic field extending through the flow transversely of the sheet formation and varying sinusoidally along the flow direction whereby to induce circulating electric currents in the molten metal which interact with the magnetic field to produce forces on the molten metal which retard the flow. The magnetic field may be induced by two sets 13 of permanent magnets 14 spaced one set to either side of the duct 11, the magnets 14 of each set being spaced along the flow direction and being of successively opposite magnetic polarity.

30 Claims, 10 Drawing Sheets

MAGNETIC BRAKING

BACKGROUND OF THE INVENTION

This invention provides a method and apparatus for magnetically braking a flow of molten metal to a metal caster. The invention has particular but not exclusive application to braking or retarding a falling flow of molten metal of a twin roll metal strip caster.

In a twin roll caster molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electro-magnetic barriers have also been proposed.

Although twin roll casting has been applied with some success to non-ferrous metals which solidify rapidly on cooling, there have been problems in applying the technique to the casting of ferrous metals. One particular problem has been the need to ensure a very even metal flow distribution across the width of the nip since even minor flow fluctuations can cause defects when casting ferrous metals. Previous proposals to achieve the necessary even flow have involved the provision of baffles and filters or inclined impingement surfaces in the delivery nozzle to reduce the kinetic energy of the falling molten metal in such a way as to produce a smooth even flow at the nozzle outlet. However these proposals have all involved impingement of a free falling stream of metal with stationary surfaces in the nozzle and it has proved difficult to achieve a controlled retardation of the molten metal while maintaining a smooth, even flow. The present invention can be applied to this problem to achieve magnetic braking of a falling stream of molten metal in the metal delivery system. It will be appreciated from the ensuing description however that the invention is not limited to this application and it may be applied to the braking of falling metal streams in other kinds of casters such as single roll drag casters, belt casters and thin slab casters.

SUMMARY OF THE INVENTION

According to the invention there is provided a method of retarding a flow of molten metal to a metal caster, comprising confining said flow within a duct having an elongate cross-section transverse to the direction of flow to shape the flow in a sheet formation, subjecting the flow in said sheet formation to a magnetic field extending through the flow transversely of the sheet formation and of the flow direction and varying generally sinusoidally along the direction of movement whereby to induce circulating electric currents in the molten metal flow which interact with the magnetic field to produce forces on the molten metal which retard the flow.

The metal flow may be a falling flow in a gravitational field. More particularly, it may be a falling sheet flow of molten steel.

The flow may be subjected to said magnetic field by passing it within said duct between two opposing sets of magnetic field inducers spaced one set to either side of the duct, the inducers of each set being spaced along the flow direction and being of successively opposite magnetic polarity, and each inducer of one set being aligned with an inducer of the other set transversely of the flow direction and being of opposite polarity.

The field inducers may comprise magnetic pole ends of respective sets of permanent magnets. The field provided by the permanent magnets may be supplemented by electromagnets.

The magnetic field may be modulated to control said retarding forces and consequently the rate of said flow.

The modulation of the magnetic field may be achieved by causing relative movement between said two sets of magnetic field inducers whereby to vary the magnetic field in the gap between them. That relative movement may be such as to vary said gap and/or to vary the orientation of one set of inducers relative to the other such as to modify the alignment of the inducers of one set with the inducers of the other set.

Said movement may comprise linear bodily movement of the two sets of inducers toward and away from one another. Alternatively, it may comprise pivoting movement of the two sets of inducers.

In the case where the magnetic field is supplemented by electromagnets, modulation of the field may alternatively be achieved by varying electrical input to the electromagnets.

The invention also provides apparatus for controlling a flow of molten metal to a metal caster, comprising a duct to confine the flow and having an elongate cross-section to shape the flow in a sheet formation, and a magnetic field generator to generate a magnetic field extending transversely through the duct and varying generally sinusoidally along the duct whereby to induce electric currents in the molten metal flow which interact with the magnetic field to produce retarding forces on the molten metal flow.

In one particular application the invention provides a method of continuously casting metal strip of the kind in which molten metal is introduced into the nip between a pair of parallel casting rolls via a metal delivery nozzle disposed above the nip to create a casting pool of molten metal supported on casting surfaces of the rolls immediately above the nip and the casting rolls are rotated to deliver a solidified metal strip downwardly from the nip, wherein molten metal is delivered to the nozzle in a falling stream through a confining vertical duct having an elongate cross-section which shapes the stream in a sheet formation and the stream of falling molten metal is retarded by subjecting it to a magnetic field extending generally horizontally through it transversely of the sheet formation and varying generally sinusoidally in the vertical direction of fall whereby to induce electric currents in the falling metal stream which interact with the magnetic field to produce forces on the falling stream which retards its falling movement.

The vertical duct may serve as a submerged entry nozzle for entry of molten metal into the delivery nozzle.

The invention further extends to apparatus for continuously casting metal strip comprising a pair of casting rolls forming a nip between them, a metal delivery nozzle for delivery of molten metal into the nip between the casting rolls to form a casting pool of molten metal supported on casting roll surfaces immediately above the nip, roll drive means to drive the casting rolls in counter-rotational directions to produce a solidified strip of metal delivered downwardly from the nip, molten metal supply means including a vertical duct of elongate cross-section through which to supply molten metal to the delivery nozzle in a falling stream of sheet formation, and magnetic field generator means to generate a magnetic field to extend generally horizontally through the falling molten metal stream and to vary generally sinusoidally in the vertical direction of the falling movement whereby to induce electric currents in the falling stream which interact with the magnetic field to produce forces on the falling metal stream to retard its falling movement.

BRIEF DESCRIPTION OF THE DRAWINGS

The principles of the invention and its application to the metal delivery system of a twin roll caster will now be described in some detail with reference to the accompanying drawings in which:

FIG. 10 diagrammatically illustrates one manner of modulating the magnetic field generated by the braking system of;

DETAILED DESCRIPTION OF THE PREFERRED EMBODIMENTS

Figure 1:
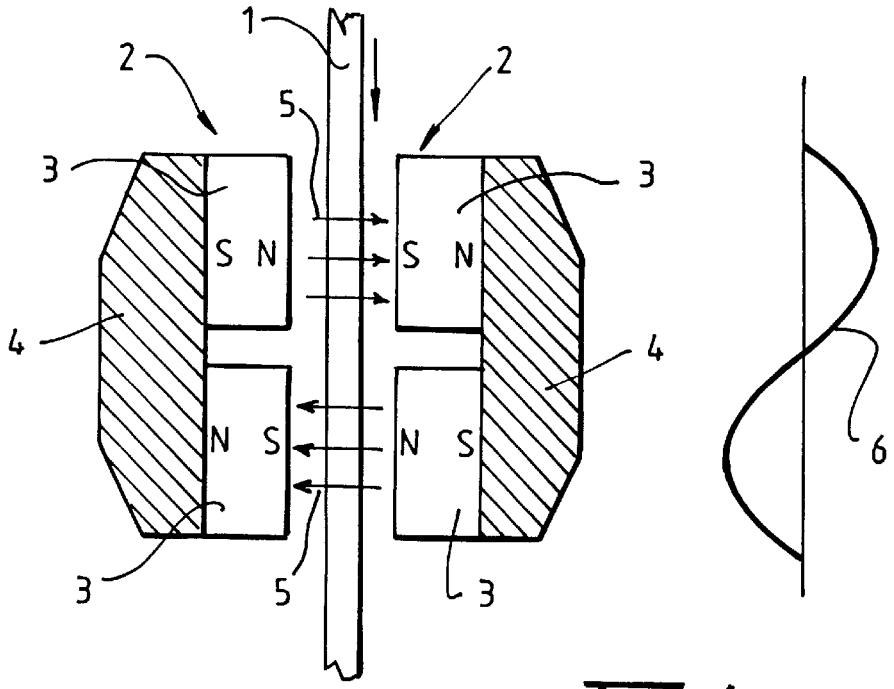
FIG. 1 in a schematic representation of a magnetic braking system in accordance with the invention.

FIG. 1 diagrammatically illustrates a braking system in accordance with the present invention which makes use of a static magnetic field generated by permanent magnets in order to retard movement of a falling sheet 1 of an electrically conductive molten metal. The magnetic field is generated by two sets of field inducers denoted generally as 2, each set being comprised of a pair of vertically spaced inducers 3. The two sets of inducers are arranged one set to each side of the falling sheet 1. The inducers of each set are of successively opposite polarity in the vertical direction of fall of the sheet and the inducers of one set are aligned horizontally with the inducers of the other set, the inducers of the two opposing sets being of opposite polarity. The diagram illustrates the inducers as permanent magnets connected by field return pieces 4 which can be made of a magnetic material such as mild steel.

The magnetic flux generated by the field inducers 3 penetrates the falling sheet at right angles as indicated by the arrows 5 in FIG. 1. The field varies generally sinusoidally in the vertical direction of fall as indicated by the curve 6 in FIG. 1. The approximation to a true sinusoid becomes more accurate as the size of the air gap is increased. Braking applications in accordance with the invention may often use a large air gap to accommodate the sheet and any thermal insulation which may be necessary. For the purposes of analysis the flux density is assumed to be constant across the width of the sheet.

Figure 2:
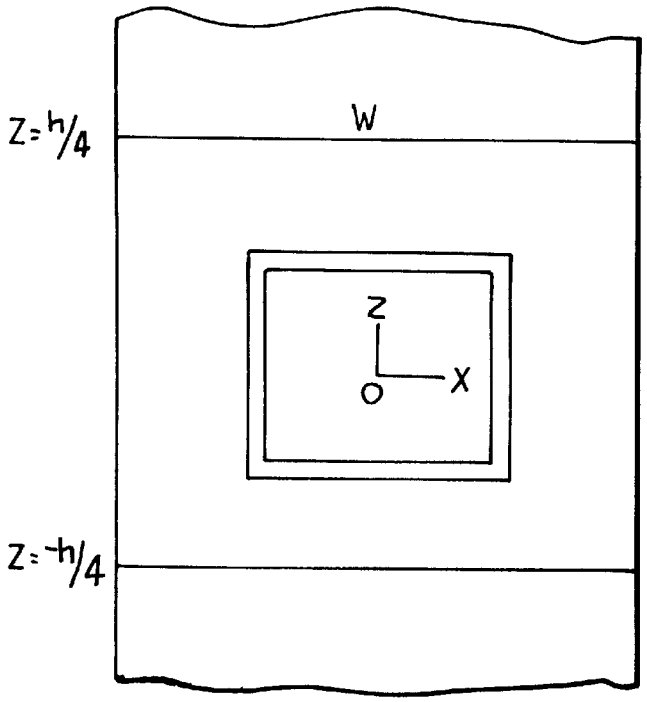
FIG. 2 shows the general configuration of the system for the purposes of analysis.

The following analysis is provided to enable calculation of braking forces needed in the design of braking systems in accordance with the invention. The general configuration to be considered for the purposes of analysis is shown in FIG. 2. With reference with this figure, we may consider a flat conducting sheet of width w, thickness T, and conductivity σ moving with velocity v in the vertical z direction. The y direction is into the page in FIG. 2. Only a section of the sheet between two opposing pole pairs is shown. It is assumed that the sheet extends vertically beyond the magnetic field. Let H be the height of sheet to be supported, t be time, g be the gravitational acceleration (−9.8 m/s$^2$), and D be the density of the sheet. Let N be the number of equispaced magnetic poles on each side of the sheet, and h be the height equivalent to one sinusoid. The magnetic field is in the y direction, is constant across the sheet, and is given by $$B_y(z)=M\sin(2\pi z/h),\ -Nh/4<z<Nh/4 \tag{1}$$

where M is a constant.

FIG. 2 illustrates the part of the sheet covered by the central half sine wave of (1). Each region between adjacent magnet poles can be treated similarly (apart from minor end effects at the first and last opposing pole pairs). In each such region the induced current will travel around the region centre (ie the origin in FIG. 2). We make the approximation that the current paths are contiguous rectangular strips like the one shown in FIG. 2. These strips fill the region being considered and can be considered to be insulated from each other.

We are now in a position to calculate the braking force on the sheet by separately considering the regions between adjacent poles, and the two end regions. Within each region, a single rectangular strip is considered, and integration over this gives the force on the region.

Let dI(z) be the current induced in a rectangular strip of size 2x*2z and width dz. The geometry of the loop requires that $$x=z2w/h \tag{2}$$

The voltage induced in the moving strip is $$V(z)=-d\Phi/dt=-4B_y(z)xv \tag{3}$$

$$=-8B_y(z)wzv/h,\ z>0$$

where Φ is the magnetic flux through the rectangular strip. The resistance of the rectangular strip is $$dR(z) = 2x/(\sigma T dz) + 2z/(\sigma T dx) \tag{4}$$

$$= z(4w^2 + h^2)/(hw\sigma T dz),\ z > 0$$

We then have $$dI(z) = V/dR \tag{5}$$

$$= -8vB_y(z)w^2\sigma T dz/(4w^2 + h^2),\ z > 0$$

The total upwards force on top and bottom strip segments is $$dF(z) = B_y(z)dI\,4x \tag{6}$$

$$= -32B_y^2(z)w^3\sigma Tvz dz/(h(4w^2 + h^2))$$

This gives the total force on the region between the two adjacent poles as:

$$F = (32vM^2w^3\sigma T/(h(4w^2 + h^2)))\int_0^{h/4} z\sin^2(2\pi/h)dz \tag{7}$$

$$= -(8vM^2w^2\sigma hT/(\pi^2(4w^2 + h^2)))\int_0^{\pi/2} a\sin^2(a)da$$

$$= -.703vM^2w^3\sigma hT/(4w^2 + h^2)$$

A similar approach can be used to calculate the force on the region above the top magnetic pole. The field in this region will fall off more slowly than is given in (1), and so we assume that the falloff is sinusoidal but over distance h/2 instead of h/4. This leads to the same result as in (7) except that 0.703 is replaced by 0.2685.

The general result for the full braking force in Newtons is then $$F = -(0.703(N-1) + 0.537)vM^2w^3\sigma hT/(4w^2 + h^2) \tag{8}$$

$$= -0.703(N - 0.236)vM^2w^3\sigma hT/(4w^2 + h^2)$$

We note that dF/dh=0 for h=2w. This means that if N is fixed and the space for the magnets is not constrained, then the best vertical pole spacing to use is w.

It is interesting to note that if H is fixed, and N and h are allowed to vary with N=H/h, then F becomes constant at large N.

The braking power P is given by Fv and all of this power goes into heating the sheet.

We now calculate the magnetic field induced at the origin in FIG. 2. this can be calculated by considering each strip loop separately and then integrating.

The induced field at the origin is given by $$dB_{y,i}(0,0)=\mu_0 dI(x^2+z^2)^{0.5}/(\pi xz) \tag{9}$$

This leads to $$B_{y,i}(0,0)=0.000002193vMw\sigma(4w^2+h^2) \tag{10}$$

The total magnetic field in the y direction is given by $$B_{y,t}=B_y+B_{y,i} \tag{11}$$

Along the vertical sheet centre line, the original magnetic field is effectively pulled downwards by the moving sheet. The induced field should ideally be 0 on the line between opposing magnet poles, maximum at the origin (as in FIG. 2), and approximately sinusoidal along the vertical centre line. The induced field will be reversed in sign at the sides of the sheet when compared to the centre.

The total magnetic field $B_{y,t}$ rather than $B_y$, should have been used in (3). However this will make very little difference.

As an example of the braking force which can be generated, we consider the following parameter setting for a falling steel sheet:

N=4,
v=−2 m/s,
σ=700000 (ohm.m)$^{-1}$,
M=0.6 Tesla,
T=0.01 m,
w=0.11 m,
h=0.22 m,
H=0.44 m, and
D=7800 kg/m$^3$.

Substitution into (8) gives F=40.3 Newtons (an upwards force) and a braking power of 80.7 Watts. By comparison the force due to the weight of the sheet is −37 Newtons. The sheet speed for constant velocity is −1.84 m/s.

Figure 3:
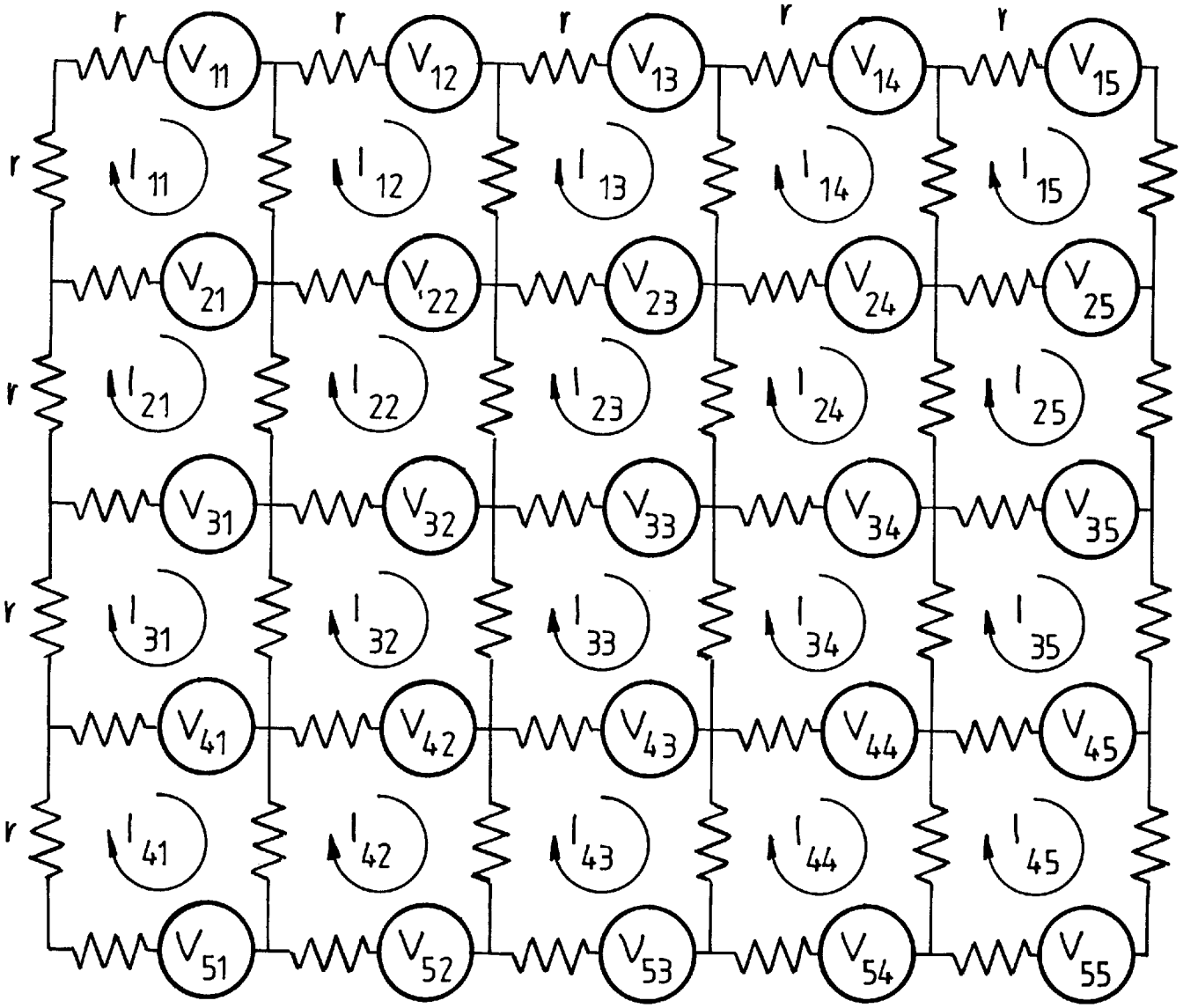
FIG. 3 gives an alternative presentation of the configuration for the purposes of mesh analysis.
Figure 4:
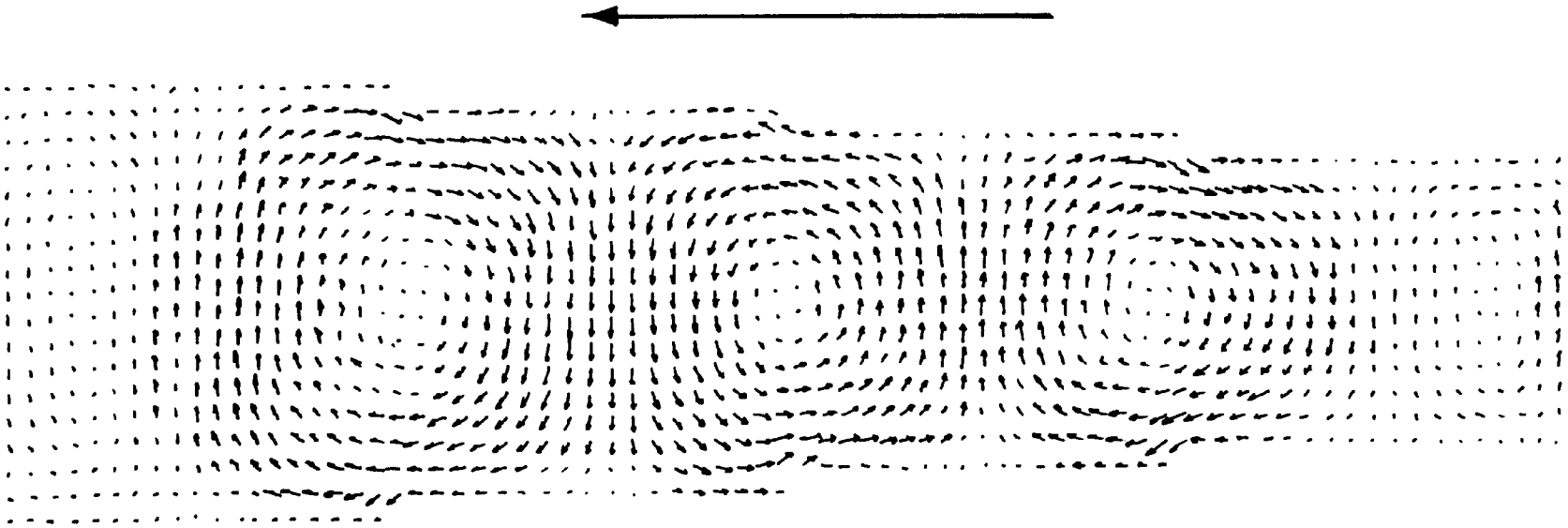
FIG. 4 illustrates the current distribution induced by the system as derived by mesh analysis.

We have made a further analysis using mesh analysis techniques. In this technique the falling sheet is modelled by a square mesh of equal value resistors as illustrated in FIG. 3 and forecasts a current flow distribution as seen in FIG. 4. The induced voltage per cell is determined by the magnetic flux at a given cell and a velocity of the falling sheet. Applying this technique to the same parameters as set out above suggests that a braking force of 43 newtons will be generated which should be a more accurate value because it does not use the rectangular current path approximation. The approximation will over estimate the electrical resistance of each strip loop n FIG. 2 since the real currents paths are more rounded, especially in the region between the magnetic poles. A reduced resistance will result in a higher induced current and a correspondingly greater braking force. However with this qualification the above approximate general formula (8) can be used to calculate the braking force on a falling metal sheet in a sinusoidal magnetic field.

Figure 5:
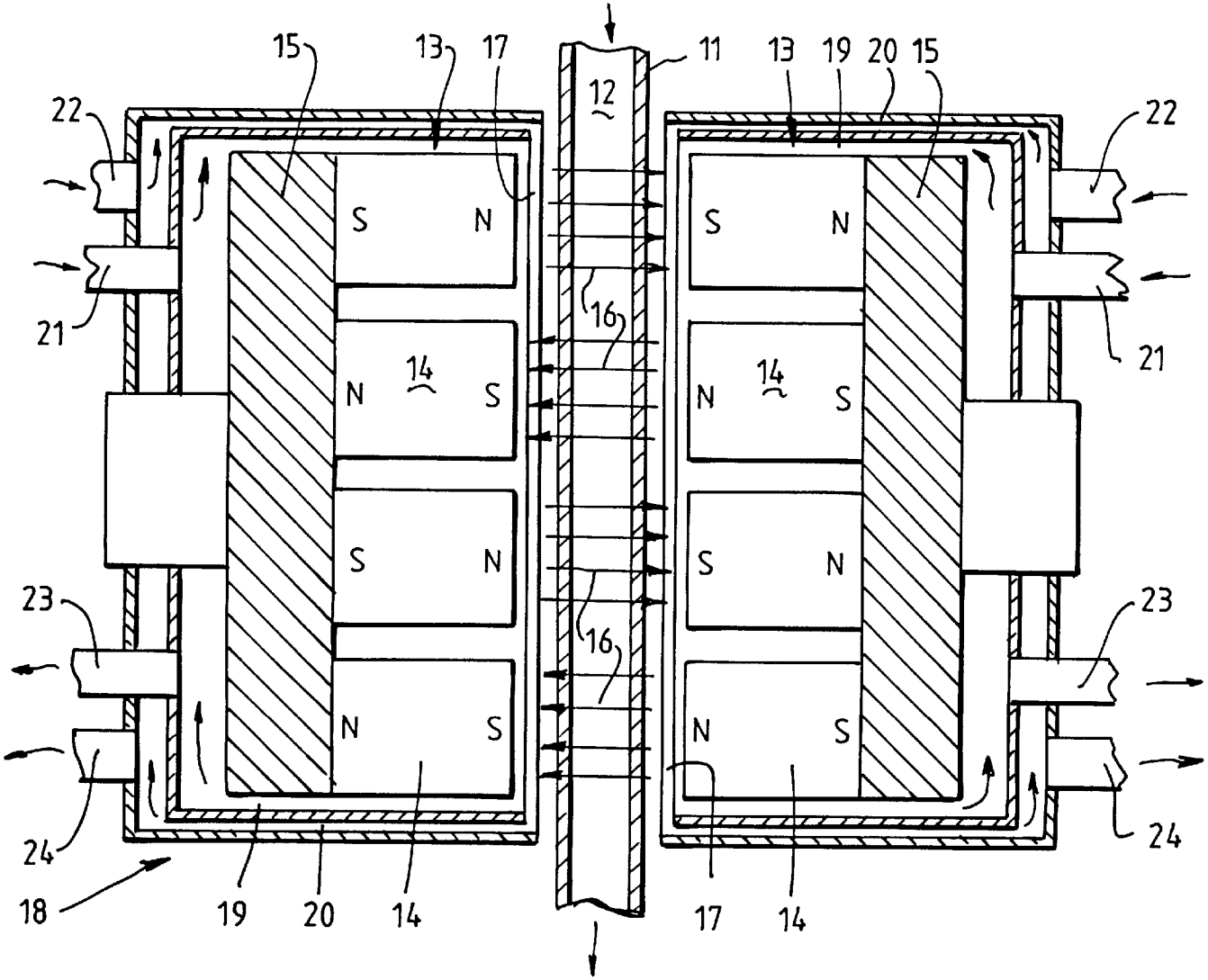
FIGS. 5 and 6 schematically illustrate one specific embodiment of a braking system.
Figure 6:
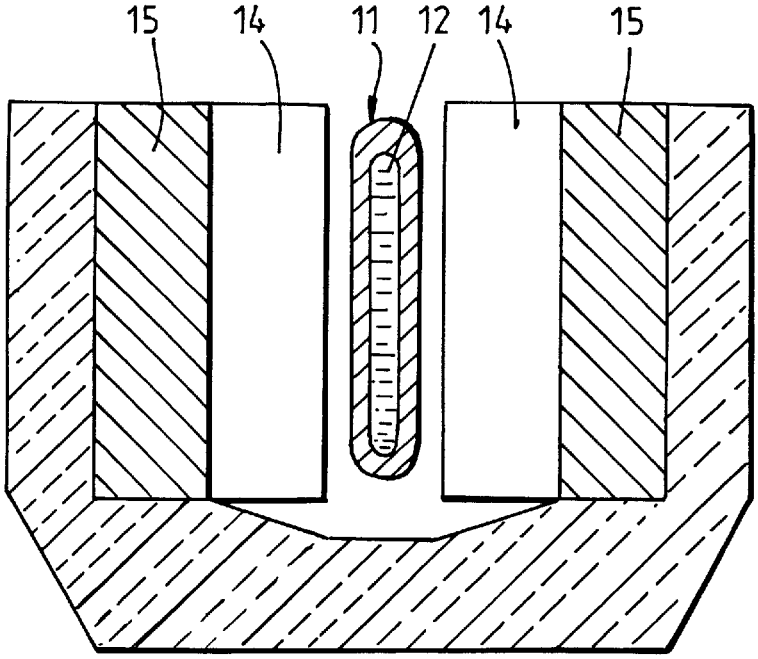

FIGS. 5 and 6 illustrate schematically a magnetic brake system designed in accordance with the present invention for braking the fall of molten metal through a vertical duct 11 which may be a submerged entry nozzle for the supply of molten metal into a delivery nozzle or some other component of a metal caster. Duct 11 is of elongate cross-section so that the falling molten metal 12 within it has a sheet configuration.

The magnetic brake comprises two sets 13 of permanent of magnets 14 disposed one set to each side of the duct 11 with the magnets of each set spaced vertically along the duct with successive magnets in each set being arranged with their polarity reversed and the magnets of one set being horizontally aligned with the magnets of the other set with their polarities reversed. The magnets are in the form of elongate bars which are inserted into cells in a suitable holding structure so as to engage a pair of outer mild steel plates 15 which provide return paths for the magnetic field. With this arrangement the magnets generate a very strong field which extends horizontally between the magnets as indicated by the arrows 16 to intersect the falling molten metal at right angles and to vary sinusoidally in the vertical direction through two complete sine waves.

The magnets may be shielded by stainless steel thermal barrier sheets 17 and the magnet mounting structure may be enclosed in a double shell casing defining inner and outer cooling chambers 19, 20 supplied with cooling air flows through appropriate inlet ducts 21, 22 and outlet ducts 23, 24.

Figure 7:
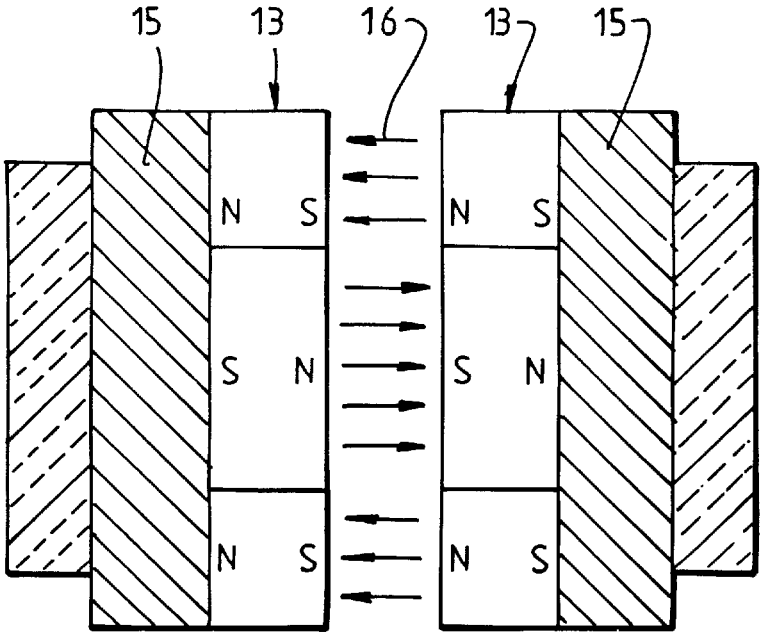
FIG. 7 illustrates a modified version of the braking system.

Although it is preferred for most effective braking to have at least two complete sine wave fluctuations in the magnetic field, there are applications in which the space available for the braking system does not permit this and it may be necessary to use a 1.5 sine wave magnet system as illustrated in FIG. 7.

Figure 8:
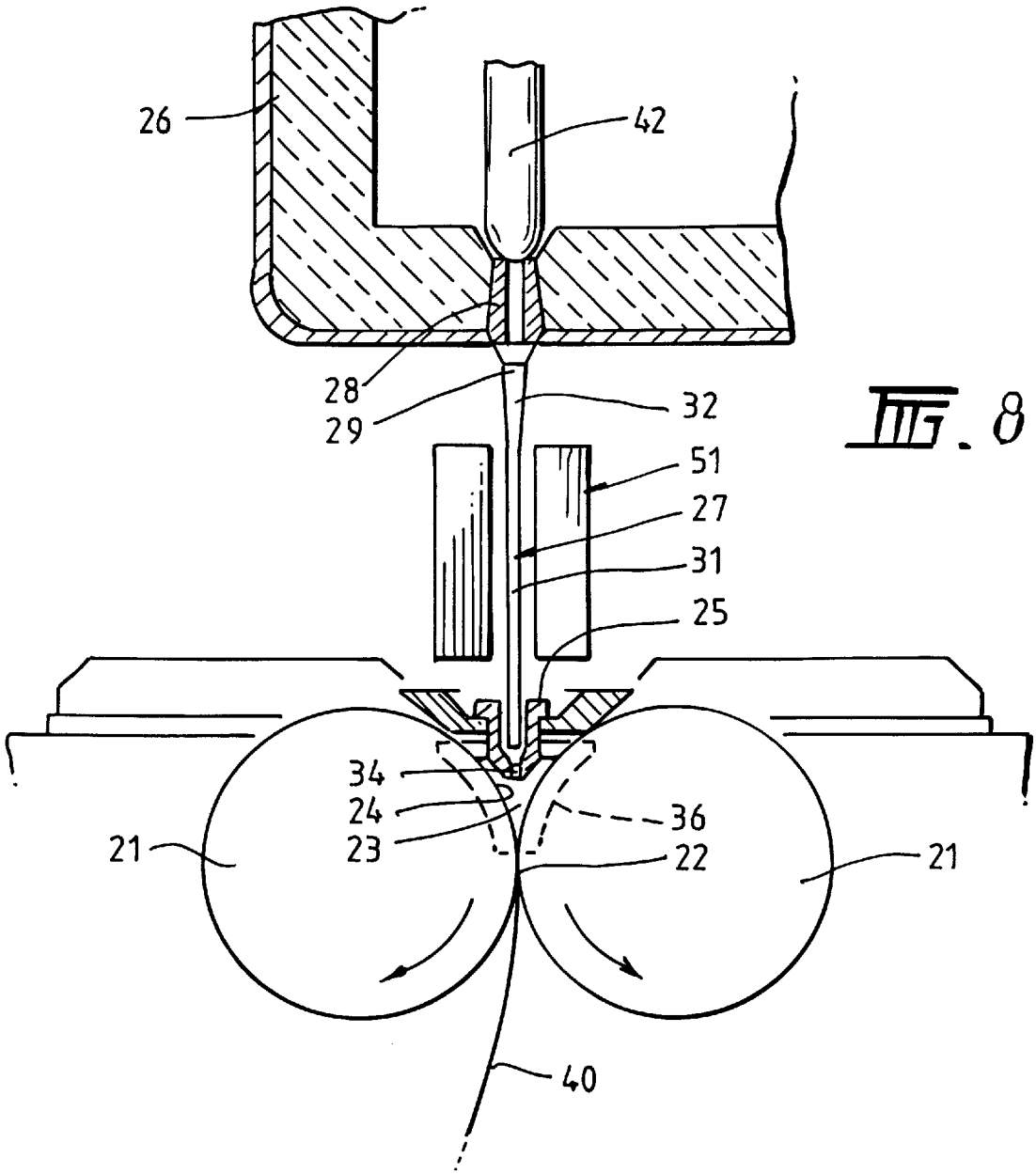
FIG. 8 is a vertical cross-section through a twin roll strip caster having a metal delivery system incorporating a magnetic braking device in accordance with the invention.
Figure 9:
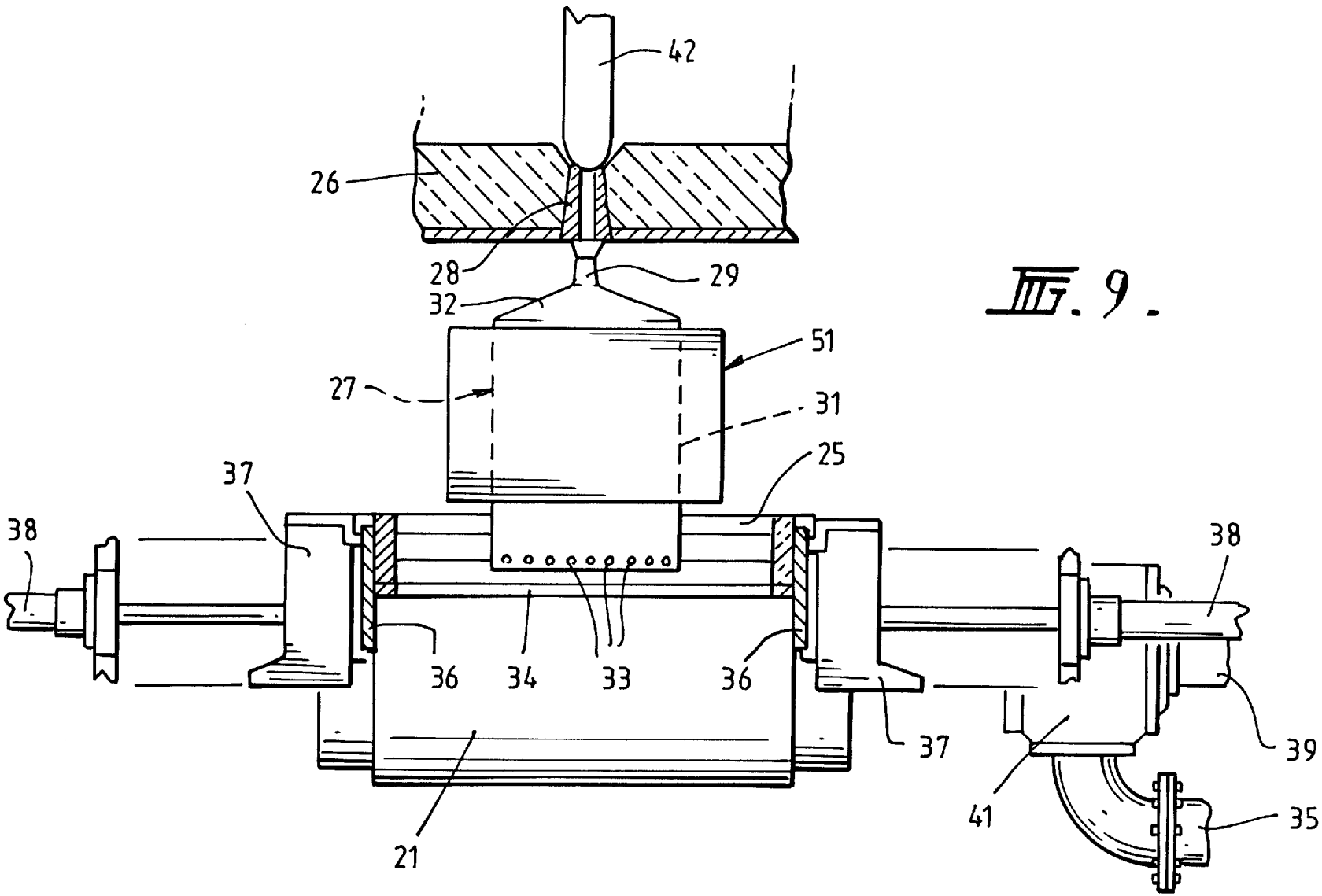
FIG. 9 is a side elevation of the caster shown in FIG. 8.

FIGS. 8 and 9 illustrate a twin roll continuous strip caster provided with a metal delivery system incorporating a magnetic brake in accordance with the present invention. This caster comprises a pair of horizontal casting rolls 21 forming a nip 22 between them. Molten metal is delivered to a casting pool 23 supported on the casting surfaces 24 of rolls 21 immediately above the nip by means of an elongate metal delivery nozzle 25 extending along the nip. Metal delivery nozzle 25 receives molten metal directly from a ladle 26 through a submerged entry nozzle 27 extending from a ladle outlet 28 downwardly into the delivery nozzle. The submerged entry nozzle 27 comprises a tubular upper portion 29 for connection with the ladle outlet 28 and a lower generally elongate section 31 of generally rectangular cross-section extending along the delivery nozzle, the two sections 29 and 31 being connected by a transition section 32. The lower end of section 31 extends into the bottom of delivery nozzle 25 and has two longitudinal side walls are provided with rows of outlet openings 33 for flow of metal into the delivery nozzle. The metal in the delivery nozzle covers the lower end of the submerged entry nozzle including the delivery openings 33 and passes through a slot outlet 34 from the delivery nozzle into the casting pool. The flow conditions are such that the casting pool covers the bottom end of the delivery nozzle including the slot outlet 34.

The casting pool is confined at the two ends of the nip by a pair of side dam plates 36 which are held in plate holders 37 and pressed against the ends of the casting rolls by operation of hydraulic cylinder units 38. The casting rolls are contra-rotated through drive shafts 39 from an electric motor and transmissions so as to produce a solidified strip 40 passing downwardly from the nip. The rollers have copper peripheral walls formed with a series of longitudinally extending and circumferentially spaced water cooling passages supplied with cooling water through the roller ends from water supply ducts in the roller drive shafts 38 which are connected to water supply hoses 39 through rotary gland 41.

Ladle 26 is of conventional construction. It may be supported via a yoke from an overhead crane whereby it can be brought into position from a hot metal receiving station and connected to the upper end of the entry nozzle 27. The ladle is fitted with a stopper rod 42 actuable by a servo-cylinder to control the flow of molten metal through the outlet 28 to the entry nozzle 27.

In accordance with the present invention, a magnetic braking device denoted generally as 51 is provided about the submerged entry nozzle 27 so as to be effective to retard the fall of the molten metal flowing through the nozzle. The magnetic brake may have the construction as described above with reference to FIGS. 5 to 8 and details of the construction need not be redescribed here. Suffice to say that the two sets of magnets of the magnetic brake are disposed one to each side of the elongate section 31 of the entry nozzle 27. The molten metal flowing from the ladle outlet 28 undergoes a transition from a cylindrical flow stream to a stream in the shape of an elongate sheet within the general confines of the elongate nozzle section 31. The magnets of the magnetic brake 51 generate a magnetic field in which the flux passes horizontally through the falling sheet of metal and in which the field strength varies sinusoidally in the vertical direction. The magnetic brake may be of the kind illustrated in the FIGS. 5 and 6 so as to provide a field which varies through two sine waves or if space does not permit this it may be of the general form illustrated in FIG. 7 so that the field varies through only 1.5 sine waves.

It is quite possible with the illustrated arrangement to produce sufficient braking of the flowing metal to produce a very significant slowing of the falling stream so that kinetic energy is removed from it while the stream maintains a steady state flow. The slowing effect may be such that the metal can flow directly from the bottom end of the submerged entry nozzle into the delivery nozzle 25 without the need for baffles or other flow retarding elements.

The flow of molten metal through the delivery system to the casting pool may be controlled solely by movements of the stopper rod 42 in response to measurements of the casting pool depth. In that event the entry nozzle 27 must be of such dimensions that it is not entirely filled by the molten metal falling through it, so as to allow expansion of the sheet width necessary to maintain a constant flow rate as the velocity of the stream is reduced. However, it is possible to modulate the magnetic field so as to control the velocity of the falling stream in the manner to be distributed below in order to maintain a constant flow rate and in this case it is possible to completely fill the flow duct with molten metal.

The illustrated caster may be used for continuous casting of steel strip. Typically the rollers may be about 500 mm diameter and about 1500 mm long to produce strip up to about 1500 mm wide. Molten steel is particularly susceptible to the present invention since it is non magnetic but very conductive. In a typical caster the metal flow rate through the delivery system may be of the order of $2\times10^{-3}$ $m^3/s$ which is equivalent to about 15.6 kg/s. The liquid metal may fall through a distance of about 0.5 m before entering the magnetic field of the magnetic brake 51, in which case it will develop a power due to gravity at entry to the magnetic field of the order of 73 w and have achieved a velocity of about 3 m/s. If the total length of the entry nozzle 27 is of the order of 1 meter and the permanent magnets in the magnetic braking system provide a nominal peak flux density of the order of 0.6 Tesla it is quite possible to remove well in excess of 100 watts of power by the magnetic braking system so that the exit velocity from the SEN can be reduced to less than 2 m/s.

Although electromagnetic braking can achieve a reduction of the kinetic energy in a falling stream of molten metal it does not necessarily alter the flow rate. In a strip caster, the flow rate is primarily set by a ladle stopper or gate valve in the metal delivery system. During different stages of the casting process, the flow rate may need to be changed by up to a factor of 2 and if the electromagnetic braking effect remains constant this can cause liquid metal to back up in the metal delivery system. It is therefore useful to provide for modulation or dynamic control of the braking magnitude. Such control can enable a system in which the flow of liquid metal completely fills the containing tube and the magnetic braking becomes the prime means of flow control.

In the illustrated magnetic braking systems, the peak flux density generated in the gap between the magnets is strongly related to the width of the gap. A modest increase in gap width will result in a significant reduction of peak flux. Accordingly any means of varying the gap width during operation may in principal be used to control the braking force and a variation of peak flux by a factor of 2 will result in force change by a factor of 4.

In practical braking systems employing powerful magnets, the attractive forces across the gap are very large. They may, for example, be greater than half a metric tonne. Accordingly any mechanical arrangement to vary the width of the gap must be capable of supporting forces of this magnitude and to operate against them.

Figure 10:
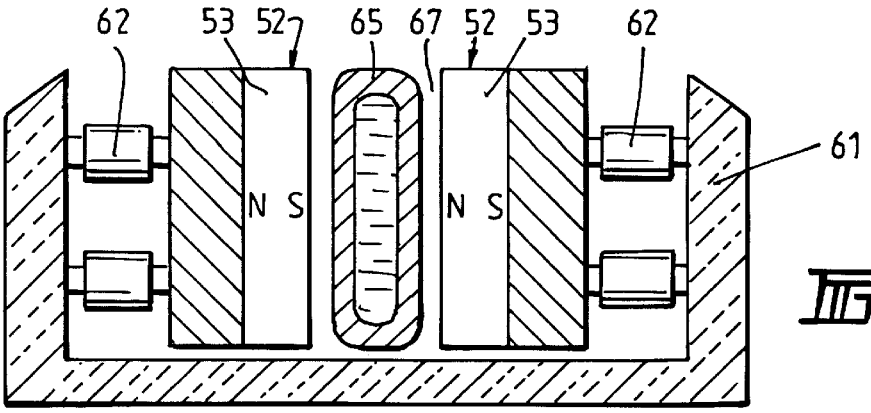

One appropriate arrangement for changing the gap width to produce field modulation is illustrated in FIG. 10.

In this arrangement the sets 52 of permanent magnets 53 are mounted within a generally U-shaped yoke 61 and are connected to the outer limbs of the yoke by hydraulic actuators 62 by means of which they can be moved bodily with linear movement toward and away from one another whereby to vary the gap 67 while maintaining the position of duct 65 centrally within the gap. Yoke 61 may have a suitably massive construction to support the forces generated between the magnets and by the hydraulic actuators 62 and this arrangement provides a robust and reliable means of varying the gap without the need for any high voltage electrical system in the vicinity of the liquid metal. It also maintains regularity of the magnetic field across the duct 65.

Figure 11:
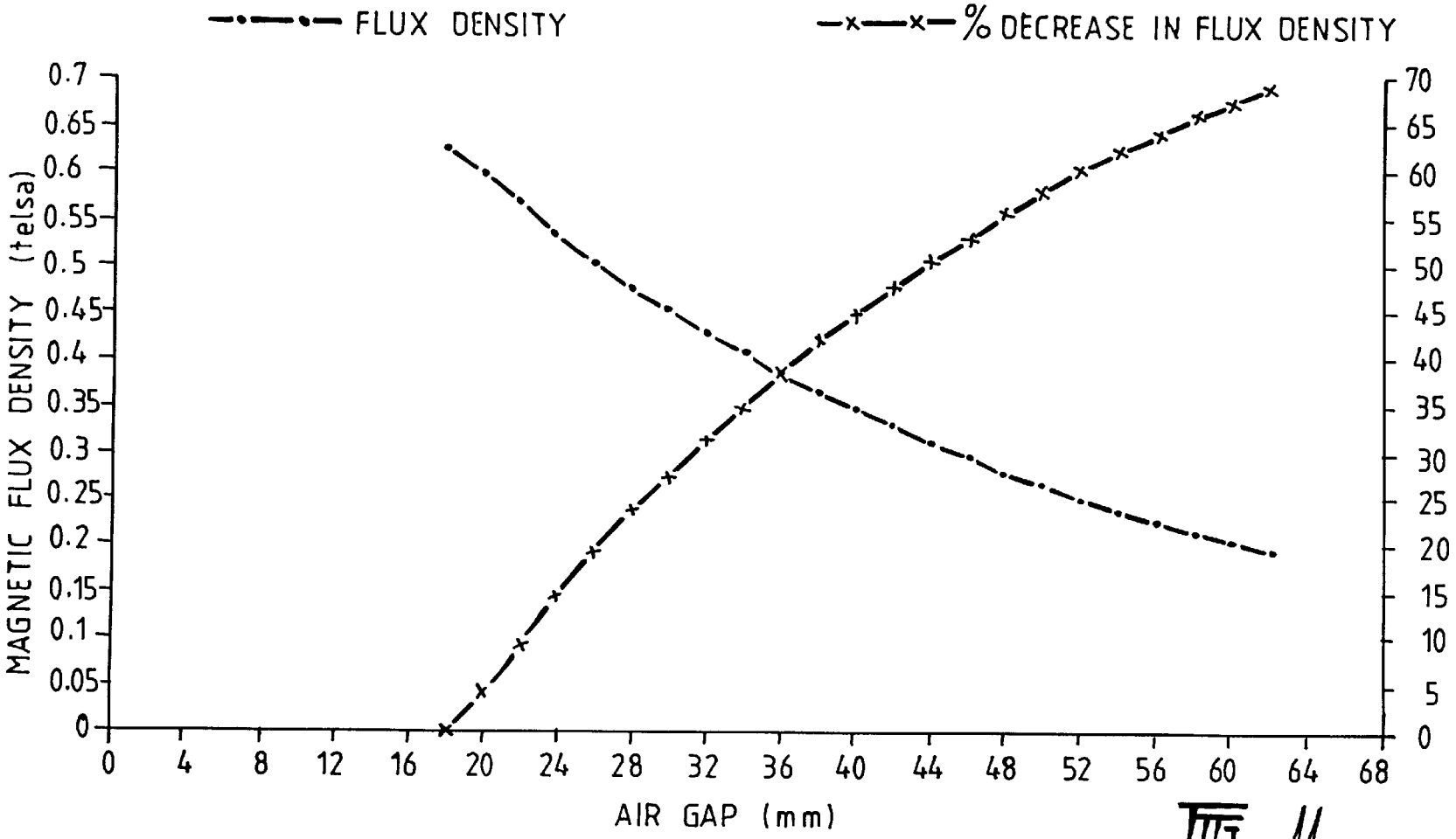
FIG. 11 plots typical magnetic flux variations achievable by the arrangement illustrated in FIG. 10.

FIG. 11 illustrates a typical plot of peak flux density versus gap achievable by use of a system as illustrated in FIG. 10.

Figure 12:
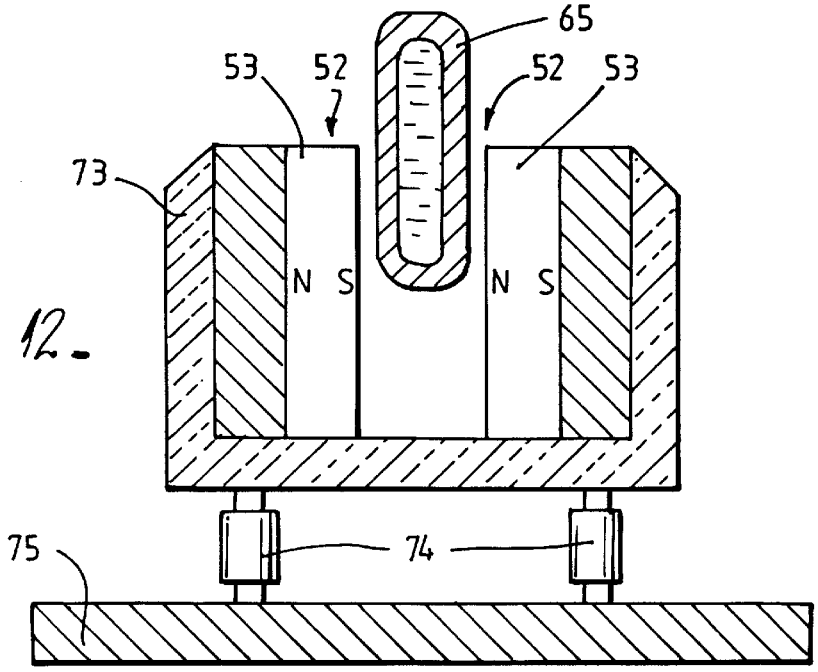
FIG. 12 illustrates an alternative manner for obtaining appropriate modulation of the electromagnetic field by bodily movement of the two sets of permanent magnets relative to the falling metal.

FIG. 12 diagrammatically illustrates an alternative mechanical means of flux control. In this case the two sets 52 of permanent magnets 53 are fixed within a yoke 73 which can be physically withdrawn away from duct 65 by the operation of hydraulic actuators 74 connected to a fixed structure 75.

Figure 13:
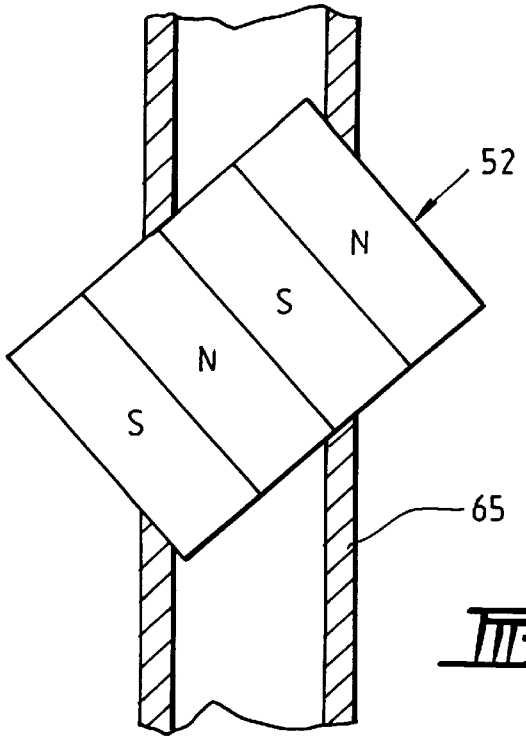
FIG. 13 illustrates a further alternative for obtaining field modulation by rotation of the two sets of permanent magnets together as a unit.
Figure 14:
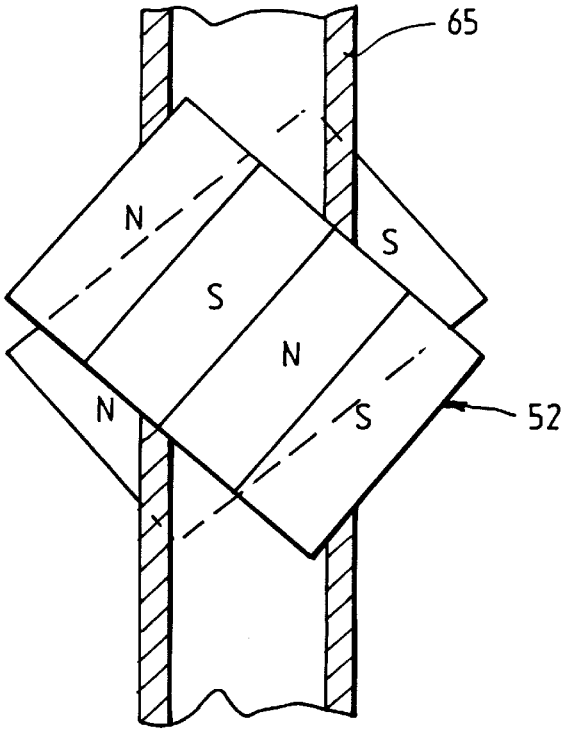
FIG. 14 illustrates a further alternative of obtaining magnetic field modulation by contra-rotation of the two sets of permanent magnets.

FIGS. 13 and 14 illustrate further alternative mechanical means for flux control in which the two sets of magnets are rotated. In the arrangement illustrated in FIG. 13 the two sets of magnets rotate together as a unit relative to the duct 65 whereas FIG. 14 illustrates relative rotation of the two sets of magnets which has the effect of varying the alignment of the poles of one magnet set relative to the other.

The arrangements illustrated in FIGS. 12, 13 and 14 all produce irregularities in the magnetic field across the width of duct 65 resulting in a variation of flow rate across the outlet of the duct. This may not be acceptable in some applications of the invention and the arrangement illustrated in FIG. 3 may then be preferred.

Figure 15:
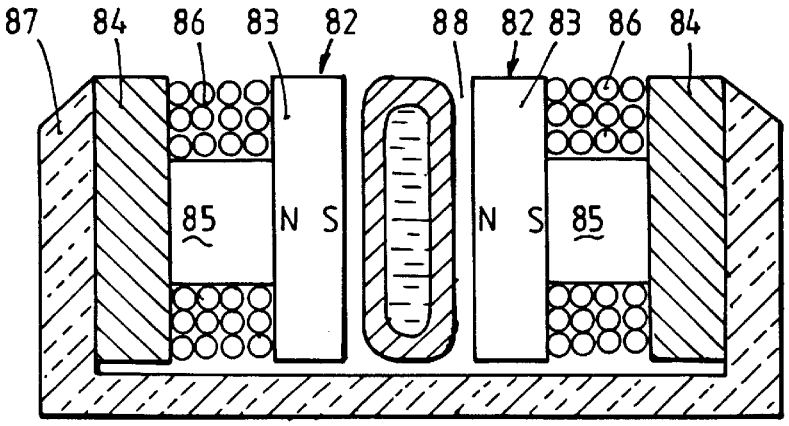
FIG. 15 illustrates a modified magnetic braking system in which field modulation is provided electromagnetically by means of electrical modulation coils.

FIG. 15 illustrates a modified braking system in which the two sets 82 of permanent magnets 83 are separated from the high permeability return pieces 84 by smaller high permeability sections 85 surrounded by water cooled copper tube electrical modulation coils 86, this assembly being mounted within a massive surrounding yoke 87. A high current, typically up to 1000 amps, can be supplied to coils 86 to augment or to reduce the flux generated in the gap 88 by the permanent magnets. In this way the advantages of the high coercivity permanent magnets can be combined with the controllability of an electromagnetic system comprising the coils 86. Trials have indicated that flux generated in a permanent magnetic system incorporating NdFeB magnets can be controlled over a range of at least plus or minus 30% by this means. A range of this magnitude enables changes of braking force to a factor greater than 3.

For some applications the combination of permanent and electromagnets will have certain advantages over a purely permanent magnet system or a purely electromagnetic system. The controllability can be very high because of the square law relation between flux density and force. The coercivity and resulting high flux density due to the permanent magnets can be further enhanced by the additional coercivity of the electromagnet. If the electrical supply fails, the system reverts to a mean braking condition which can be designed to be "fail safe".

The illustrated embodiments of the invention and its application to twin roll strip casting have been described by way of example only and the invention has much wider application. For example a magnetic braking system in accordance with the invention may be applied to submerged entry nozzles in other metal casting systems. Although in many cases it will be sufficient to use permanent magnets only to generate the fluctuating magnetic field, it may be necessary in some cases to supplement the magnetic field with flux generated by electro-magnetic coils. This would also enable the fields to be continuously modulated in response to a control system in order to control the flow rate. By the use of very powerful magnets or electro-magnets, it is feasible in accordance with the invention to slow a falling molten metal stream sufficiently to enable it to solidify as it is falling, thereby enabling a direct free fall casting technique in which metal is transformed from a falling molten stream to a solid strip either while in unconfined free fall or while falling through an enclosing duct of appropriate cross-section to produce the required formation in the final solidified product. The invention is also applicable to the casting of copper and aluminium. It is therefore to be understood that the invention has very wide application and that the exact form of apparatus may be varied considerably according to the particular application.

We claim:

1. A method of retarding a flow of molten metal to a caster, comprising confining said flow within a duct having an elongate cross-section transverse to the direction of flow to shape the flow in a sheet formation, subjecting the flow in said sheet formation to a magnetic field extending through the flow transversely of the sheet formation and of the flow direction and varying generally sinusoidally along the direction of flow whereby to induce circulating electric currents in the molten metal flow which interact with the magnetic field to produce throughout the duct forces acting on the molten metal against the direction of the metal flow and cumulative to produce a total braking force which retards the flow substantially uniformly across the duct.

2. A method as claimed in claim 1, wherein the metal flow is a falling flow in a gravitational field.

3. A method as claimed in claim 2, wherein the flow is a falling sheet flow of molten steel.

4. A method as claimed in claim 1, wherein the flow is subjected to said magnetic field by passing it within said duct between two opposing sets of magnetic field inducers spaced one set to either side of the duct, the inducers of each set being spaced along the flow direction and being of successively opposite magnetic polarity, and each inducer of one set being aligned with an inducer of the other set transversely of the flow direction and being of opposite polarity.

5. A method as claimed in claim 4, wherein the field inducers comprise magnetic pole ends of respective sets of permanent magnets.

6. A method as claimed in claim 5, wherein the field provided by the permanent magnets is supplemented by electromagnets.

7. A method as claimed in claim 1, wherein the magnetic field is modulated to control said retarding forces and consequently the rate of said flow.

8. A method as claimed in claim 1, wherein the magnetic field is modulated by causing relative movement between said two sets of magnetic field inducers whereby to vary the magnetic field in the gap between them so as to control said retarding forces and consequently the rate of flow.

9. A method as claimed in claim 8, wherein said relative movement is such as to vary the gap between the field inducers.

10. A method as claimed in claim 8, wherein said relative movement is such as to vary the orientation of one set of inducers relative to the other such as to modify the alignment of the inducers of one set with the inducers of the other set.

11. A method as claimed in claim 8, wherein said relative movement comprises linear bodily movement of the two sets of inducers toward and away from one another.

12. A method as claimed in claim 10, wherein said relative movement comprises pivoting movement of the two sets of inducers.

13. A method as claimed in claim 6, wherein electric input to the electromagnets is varied to modulate the magnetic field so as to control said retarding forces and consequently the rate of said flow.

14. A method of continuously casting metal strip comprising introducing molten metal into the nip between a pair of parallel casting rolls via a metal delivery nozzle disposed above the nip to create a casting pool of molten metal supported on casting surfaces of the rolls immediately above the nip; rotating the casting rolls to deliver a solidified metal strip downwardly from the nip, wherein molten metal is delivered to the nozzle in a falling stream through a confining vertical duct having an elongate cross-section which shapes the stream in a sheet formation; and retarding the stream of falling molten metal by subjecting it to a magnetic field extending generally horizontally through it transversely of the sheet formation and varying generally sinusoidally in the vertical direction of fall whereby to induce electric currents in the falling metal stream which interact with the magnetic field to produce forces on the falling stream which retards its falling movement, the magnetic field being provided by two sets of permanent magnets spaced one set to either side of said duct with the magnets of each set being spaced vertically along the duct and being of successively opposite magnetic polarity, each magnet of one set being longitudinally aligned with a magnet of the other set and being of opposing polarity.

15. A method as claimed in claim 14, wherein said molten metal is molten steel.

16. A method as claimed in claim 14, wherein the vertical duct serves as a submerged entry nozzle for entry of the molten metal into the delivery nozzle.

17. A method as claimed in claim 14, wherein the magnetic field is modulated to control said retarding forces and consequently rate of metal flow through the vertical duct.

18. Apparatus for controlling a flow of molten metal to a caster, comprising a duct to confine the flow and having an elongate cross-section to shape the flow in a sheet formation, and a magnet field generator to generate a magnetic field extending transversely through the duct and varying generally sinusoidally along the duct in the direction of flow to induce electric currents in the molten metal flow which interact with the magnetic field to produce throughout the duct retarding forces on the molten metal flow which retard the flow substantially uniformly across the duct.

19. Apparatus as claimed in claim 18, wherein the magnetic field generator comprises two opposing sets of magnetic field inducers disposed one set to either side of the duct, the inducers of each set being spaced along the duct and being of successively opposite magnetic polarity, and each inducer of one set being aligned with an inducer of the other set transversely of the duct and being of opposite polarity.

20. Apparatus as claimed in claim 19, wherein the magnetic field generator comprises two sets of permanent magnets having pole ends constituting said field inducers.

21. Apparatus as claimed in claim 20, wherein the two sets of permanent magnets are mounted for relative movement to vary the gap between them.

22. Apparatus as claimed in claim 20, wherein the two sets of permanent magnets are mounted for relative movement to vary the orientation of one set of magnets relative to the other set.

23. Apparatus as claimed in claim 19, wherein the magnetic field generator further comprises two sets of electromagnets associated with the permanent magnets and operable to supplement and modulate the field generated by the permanent magnets.

24. Apparatus for continuously casting metal strip comprising a pair of casting rolls forming a nip between them, a metal delivery nozzle for delivery of molten metal into the nip between the casting rolls to form a casting pool of molten metal supported on casting roll surfaces immediately above the nip, roll drive means to drive the casting rolls in counter-rotational directions to produce a solidified strip of metal delivered downwardly from the nip, molten metal supply means including a vertical duct of elongate cross-section through which to supply molten metal to the delivery nozzle in a falling stream of sheet formation, and magnetic field generator means to generate a magnetic field to extend generally horizontally through the falling molten metal stream and to vary generally sinusoidally in the vertical direction of the falling movement whereby to induce electric currents in the falling stream which interact with the magnetic field to produce forces on the falling metal stream to retard its falling movement, the magnetic field generator means comprising two sets of permanent magnets spaced one set to either side of said duct with the magnets of each set being spaced vertically along the duct and being of successively opposite magnetic polarity, each magnet of one set being longitudinally aligned with a magnet of the other set and being of opposing polarity.

25. Apparatus as claimed in claim 24, wherein the vertical duct serves as a submerged entry nozzle for entry of molten metal into the delivery nozzle.

26. Apparatus as claimed in claim 24, wherein the two sets of magnets are mounted for relative movement to vary the gap between them.

27. Apparatus as claimed in claim 24, wherein the two sets of permanent magnets are mounted for relative movement to vary the orientation of one set of magnets relative to the other set.

28. Apparatus as claimed in claim 24, wherein the magnetic field generator further comprises two sets of electromagnets associated with the permanent magnets and operable to supplement and modulate the field generated by the permanent magnets.

29. A method of retarding a flow of molten metal to a caster, comprising confining said flow within a duct having an elongate cross-section transverse to the direction of flow to shape the flow in a sheet formation having a major dimension perpendicular to the direction of flow, inducing braking effects in the molten metal flow by inducing circulating electric currents in the molten metal flow by subjecting the flow in said sheet formation to a magnetic field extending through the flow transversely of the sheet formation major dimension and of the flow direction and varying sinusoidally along the direction of flow, the induced circulating electric currents interacting with the magnetic field to produce throughout the duct forces acting on the molten metal against the direction of the metal flow and cumulative to produce a total braking force which retards the flow substantially uniformly across the duct.

30. An apparatus for controlling a flow of molten metal to a caster, comprising a duct to confine the flow and having an elongate cross-section to shape the flow in a sheet formation, and a magnet field generator means for generating a magnetic field extending transversely through the duct and varying generally sinusoidally along the duct in the direction of flow and inducing electric currents in the molten metal flow which interact with the magnetic field to produce throughout the duct retarding forces on the molten metal flow which retard the flow substantially uniformly across the duct.

* * * * *